United States Patent [19]

LaSpisa et al.

[11] Patent Number: 4,498,428

[45] Date of Patent: Feb. 12, 1985

[54] COMBUSTION CONTROL FOR A BOILER

[75] Inventors: Ronald J. LaSpisa; Merle R. Likins, Jr.; William R. King, all of Bartlesville, Okla.

[73] Assignee: Phillips Petroleum Company, Bartlesville, Okla.

[21] Appl. No.: 598,610

[22] Filed: Apr. 10, 1984

[51] Int. Cl.[3] ..... F22B 5/00

[52] U.S. Cl. ..... 122/448 R; 236/14

[58] Field of Search ..... 122/448 R, 448 S; 236/14, 15 E; 431/12

[56] References Cited

U.S. PATENT DOCUMENTS

| | | | |
|---|---|---|---|
| 3,607,117 | 9/1971 | Shaw et al. | 122/448 R X |
| 3,722,811 | 3/1973 | Osburn | 236/14 |
| 3,734,675 | 5/1973 | Osburn | 431/12 |
| 4,003,342 | 1/1977 | Hodgson | 122/448 R |
| 4,095,930 | 6/1978 | Boyd | 364/500 |
| 4,115,862 | 9/1978 | Stewart | 236/15 EM |
| 4,118,172 | 10/1978 | Noir et al. | 431/12 |
| 4,187,542 | 2/1980 | Ball et al. | 364/502 |
| 4,309,168 | 1/1982 | Prill et al. | 431/12 |

*Primary Examiner*—Edward G. Favors

*Attorney, Agent, or Firm*—French and Doescher

[57] ABSTRACT

A desired ratio of offgas to fuel gas is maintained for a fuel mixture supplied to the burners associated with a boiler by venting steam as required to insure than all offgas may be combusted while maintained the desired offgas to fuel gas ratio. The venting of steam causes the fuel gas control, which is based on steam pressure, to vary the flow rate of the fuel gas so as to maintain the desired offgas-fuel gas ratio. Control of the combustion process for the boiler in this manner results in total combustion of the offgas without violating process constraints.

12 Claims, 2 Drawing Figures

COMBUSTION CONTROL FOR A BOILER

This invention relates to control of a process in which a low BTU offgas is the predominate fuel utilized to supply heat to a boiler by combustion.

This invention is described in terms of combusting the offgas from a carbon black manufacturing process for the sake of illustration. However, the invention is applicable to the use of other low BTU gases if there is a need to dispose of such low BTU gases by combustion.

In the manufacture of carbon black, a large volume of low BTU gas is withdrawn from the bag filters. This low BTU gas is generally referred to as "offgas". The offgas must be disposed of but problems are often encountered in such disposal because the BTU content of the offgas is so low that it cannot be flared.

One solution to the disposal problem would be to mix a fuel gas with the offgas so as to raise the BTU content to a point where the resultant mixture could be flared. However, while this would result in disposal of the offgas, such a disposal is economically unattractive especially in the highly competitive carbon black industry.

While the BTU content of the offgas is low, it is not zero. Thus, it would be desirable to utilize the existing BTU content of the offgas. This can be accomplished by mixing the offgas with a fuel gas so as to achieve a combustible mixture and then utilizing such mixture as a fuel to a burner associated with a boiler. The combustion of the offgas can then be utilized to generate steam which is a useful product.

Because of environmental considerations, all of the offgas from the carbon black process must be combusted. Thus, it is necessary to control the boiler system in such a manner that total combustion of the offgas is maintained without violating a process constraint such as steam pressure.

It is thus an object of this invention to provide method and apparatus for controlling a boiler combustion process, in which a low BTU offgas is the primary fuel, in such a manner that all of the offgas is combusted without violating any process constraint.

In accordance with the present invention, a desired ratio of offgas to fuel gas is maintained for a fuel mixture supplied to the burners associated with a boiler by venting steam as required to insure that all offgas may be combusted while maintaining the desired offgas to fuel gas ratio. The venting of steam causes the fuel gas control, which is based on steam pressure, to vary the flow rate of the fuel gas so as to maintain the desired offgas-fuel gas ratio. Control of the combustion process for the boiler in this manner results in total combustion of the offgas without violating process constraints.

Figure 1:
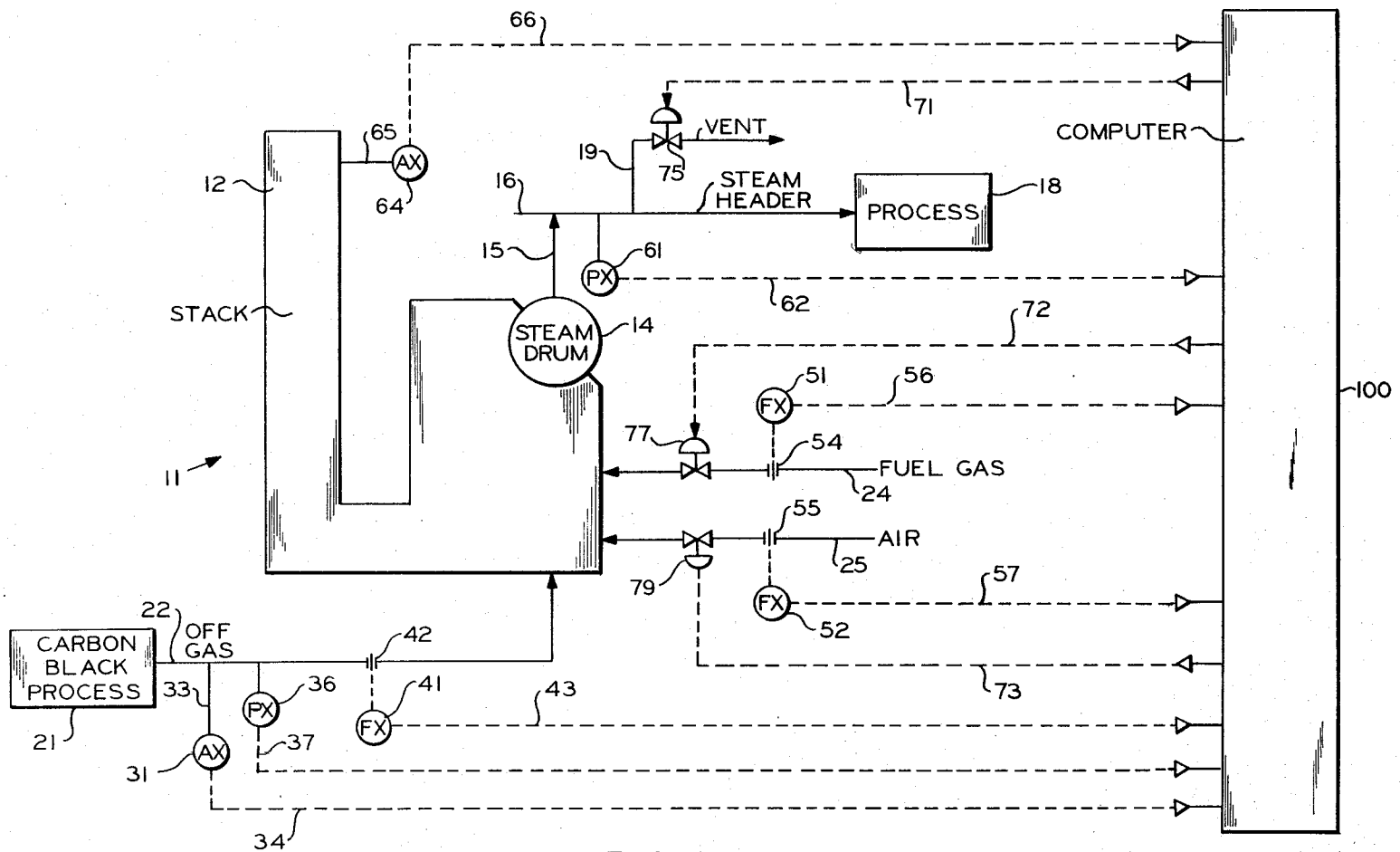
Figure 2:
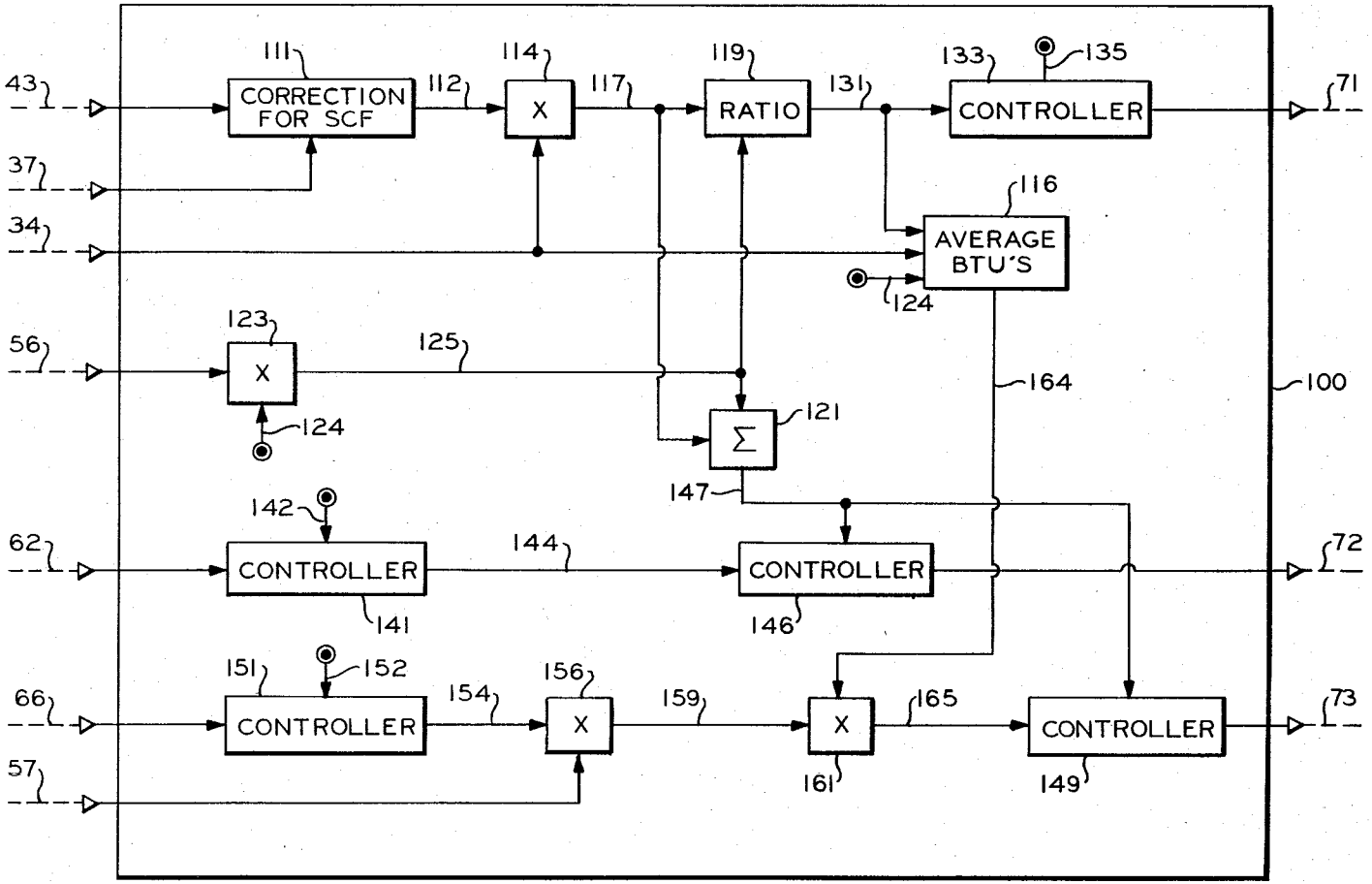

Other objects and advantages of the invention will be apparent from the foregoing brief description of the invention and the claims as well as the detailed description of the drawings which are briefly described as follows:

FIG. 1 is a diagrammatic illustration of a boiler which is supplied both offgas and fuel gas and the associated control system of the present invention; and FIG. 2 is a flow diagram of the computer logic utilized to generate the control signals illustrated in FIG. 1 based on the process measurements illustrated in FIG. 1.

The invention is described in terms of a single boiler. However, the invention is applicable to systems utilizing multiple boilers.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the art that, if a flow is measured in pneumatic form, it must be transduced to electrical form if it is to be transmitted in electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signals based on measured process parameters as well as set points supplied to the computer. Analog computers or other types of computing devices could also be used in the invention. The digital computer is preferrably an OPTROL 7000 Process Computer System from Applied Automation, Inc., Bartlesville, Okla.

Signal lines are also utilized to represent the results of calculations carried out in a digital computer and the term "signal" is utilized to refer to such results. Thus, the term signal is used not only to refer to electrical currents or pneumatic pressures but is also used to refer to binary representations of a calculated or measured value.

The controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention.

The scaling of an output signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flow equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signalvalue. A signal which is representative of a process measurement or desired process value is therefore one from which the information regarding the measured or desired value can be readily retrieved regardless of the exact mathematical relationship between the signal units and the measured or desired process units.

Referring now to the drawings and particular in FIG. 1, there is illustrated a boiler 11 having a stack 12, a steam drum 14 and a burner system associated therewith. Steam from the steam drum 14 is supplied through conduit 15 to the steam header 16. Steam in the steam header 16 may be supplied to a number of processes which are illustrated as process 18. Provision is made for venting steam from the steam header 16 through conduit 19. The process 18 may include the carbon black process and may also include other processes which are located in the plant and which has access to the steam header 16.

Offgas from the carbon black manufacturing process 21 is provided through conduit means 22 to the burners associated with the boiler 11. In like manner, fuel gas is provided through conduit means 24 and air is provided through conduit means 25 to the burners associated with the boiler 11.

Analyzer transducer 31 is in fluid communication with conduit 22 through conduit 33. Based on an analysis of the offgas flowing through conduit 22, analyzer transducer 31 provides a output signal 34 which is representative of the heating value (BTU content) of the offgas flowing through conduit means 22. Signal 34 is provided from the analyzer transducer 31 as an input to computer 100. The analyzer transducer 31 may be an Optichrom 2100 Analyzer by Applied Automation, Bartlesville, Okla.

The BTU content of the offgas will vary considerably depending upon what type of carbon black is being manufactured. Thus, it is desirable to use an analyzer to determine the BTU content. However, for any particular type of carbon black, the BTU content will remain relatively constant. Thus, if desired, the BTU content for the offgas for various types of carbon black can be determined and entered into a computer. The operator would then inform the computer what type of carbon black is being manufactured at any particular time. This would avoid the expense of the analyzer 31 but would cause some decrease in accuracy and would also require operator intervention.

Pressure transducer 36 in combination with a pressure sensing device, which is operably located in conduit 22, provides an output signal 37 which is representative to the actual pressure of the offgas. This pressure will vary considerably over a period of time. Signal 37 is provided from the pressure transducer 36 as an input to computer 100.

Flow transducer 41 in combination with the flow sensor 42, which is operably located in conduit 22, provides an output signal 43 which is representative of the measured flow rate of the offgas through conduit 22. Signal 43 is provided from the flow transducer 41 as an input to computer 100.

In like manner, flow transducers 51 and 52 in combination with flow sensors 54 and 55, which are operably located in conduit 24 and 25 respectively, provide output signals 56 and 57 respectively. Signal 56 is representative of the measured flow rate of fuel gas through conduit 24 while signal 57 is representative of the measured flow rate of air through conduit 25. Signals 56 and 57 are provided as inputs to computer 100.

Pressure transducer 61 in combination with a pressure sensing device, which is operably located in conduit 16, provides an output signal 62 which is representative of the actual steam header pressure. Signal 62 is provided from the pressure transducer 61 as an input to computer 100.

Analyzer transducer 64 is in fluid communication with the stack gases through conduit 65. Based on an analysis of the oxygen content of the stack gases, analyzer transducer 64 provides an output signal 66 which is representative of the concentration of free oxygen in the stack gases. Signal 66 is provided from the analyzer transducer 64 as an input to computer 100. The analyzer transducer may be an oxygen analyzer from Westinghouse, Computer and Instrument Division, Orville, Ohio.

In response to the described process measurements and other set point signals which will be described hereinafter, three control signals, 71, 72 and 73, are generated by computer 100. The use of these control signals to control the process illustrated in FIG. 1 is as follows:

Signal 71 is representative of the position of the control valve 75, which is operably located in the vent conduit 19, required to maintain a desired offgas to fuel gas ratio at the boiler burners. Signal 71 is provided as a control signal to the control valve 75 and the control valve 75 is manipulated in response thereto.

Signal 72 is representative of the position of the control valve 77, which is operably located in conduit 24, required to maintain a flow rate of fuel gas which will result in the maintenance of a desired steam header pressure. Signal 72 is provided as a control signal to control valve 77 and control valve 77 is manipulated in response thereto.

Signal 73 is representative of the position of control valve 79, which is operably located in conduit 25, required to maintain an air flow rate which will result in the maintenance of a desired free oxygen concentration in the stack gas. Signal 73 is provided as a control signal to control valve 79 and control valve 79 is manipulated in response thereto.

The control system illustrated in FIG. 1 is an interactive control system. Changes in the rate at which steam is vented will cause a change in the fuel gas flow rate because the steam header pressure will be affected. In like manner, a change in the fuel gas flow will cause a change in the air flow so as to maintain a desired concentration of free oxygen in the stack gas. The interactive nature of the control system and the manner in which the control system works together to insure that all offgas is combusted without violating a process constraint is more fully desired hereinafter.

Referring now to FIG. 2, signal 43, which is representative of the actual flow rate of the offgas, is provided as a first input to the correction for standard cubic feet block 111. Signal 37, which is representative of the actual pressure of the offgas, is provided as a second input to the correction for standard cubic feet block 111.

As has been previously stated, the offgas pressure is subject to substantial variation. Because of this it is desirable to apply a correction factor to the output of the flow transducer 41 to convert such output to flow in standard cubic feet. For the particular process to which the present invention was applied, the flow transducer 41 was calibrated at 18 psig. The correction factor applied to give signal 112 ($OG_{SCF}$) which is representative of the actual flow rate of the offgas in standard cubic feet per hour is given by equation 1.

$$OG_{SCF} = \left(\sqrt{\frac{P + 14.7}{32.7}}\right)(OG_m) \quad (1)$$

where

P = the offgas pressure (signal 37); and $OG_m$ = the actual measured offgas flow rate (signal 43).

Signal 112 is provided from the correction for standard cubic feed block 111 as a first input to the multiplying block 114.

Signal 34, which is representative of the actual BTU content (BTU/SCF) of the offgas is provided as a second input to the multiplying block 114 and is also provided as an input to the average BTU block 16. Signal 112 is multiplied by signal 34 to establish signal 117 which is representative of the number of BTU's per hour being provided to the boiler 11 by the offgas flowing through conduit 22. Signal 117 is provided from the multiplying block 114 as a first input to the ratio block 119 and also as a first input to the summing block 121.

Signal 56, which is representative of the actual flow rate of fuel gas through conduit 24, is provided as a first input to the multiplying block 123. The multiplying block 123 is also provided with a signal 124 which is representative of the BTU content (BTU/SCF) of the fuel gas. Generally, the BTU content of the fuel gas will be known. However, if the BTU content is not known or varies substantially, analysis can be utilized to determine the BTU content.

Signal 56 is multiplied by signal 124 to establish signal 125 which is representative of the number of BTU's per hour being provided to the boiler 11 by the fuel flowing through conduit means 24. Signal 125 is provided as a second input to the ratio block 119 and is also provided as a second input to the summing block 121.

If signal 117 is considered $OG_{BTU}$ and signal 125 is considered $FG_{BTU}$, then the output signal 131 from the ratio block 119 is given by $OG_{BTU}/(FG_{BTU}+OG_{BTU})$. Signal 131 is thus representative of the fraction of the total BTU's provided to the boiler 11 which are provided by the offgas. Signal 131 is provided as the process variable input to the controller 133 and is also provided as an input to the average BTU block 116.

For any particular set of burners there will generally be a minimum amount of fuel gas which must be utilized to achieve a proper flame. Stated in another manner, for any particular set of burners, there will be some maximum fraction of the total BTU's which may be supplied by the offgas. For the particular installation for which the present invention was applied, this maximum fraction was 0.93. This maximum fraction is supplied as the set point signal 135 to the controller 133.

In response to signals 131 and 135, the controller 133 provides an output signal 71 which is responsive to the difference between signals 131 and 135. Signal 71 is scaled so as to be representative of the position of valve 75, which is illustrated in FIG. 1, required to maintain the actual magnitude of the ratio or fraction represented by signal 131 substantially equal to the desired ratio represented by signal 135. Signal 71 is provided as a control signal from computer 100 and is utilized as previously described.

Signal 62, which is representative of the actual steam header pressure, is provided as the process variable input to the controller 141. The controller 141 is also provided with a set point signal 142 which is representative of the desired steam header pressure. In response to signals 62 and 142, the controller 141 provides an output signal 144 which is responsive to the difference between signals 62 and 142. Signal 144 is scaled so as to be representative of the total BTU's per hour which must be provided by the offgas and fuel gas to the boiler 11 in order to maintain the actual steam header pressure substantially equal to the desired steam header pressure represented by signal 142. Signal 144 is provided from the controller 141 as the set point input to the controller 146.

Signals 117 and 125 are summed in the summing block 121 to establish signal 147 which is representative of the actual total number of BTU's which are being provided per hour by the offgas and fuel gas to the boiler 11. Signal 147 is provided as the process variable input to the controller 146 and also as the process variable input to the controller 149.

In response to signals 144 and 147, the controller 146 provides an output signal 72 which is responsive to the difference between signals 144 and 147. Signal 72 is scaled so as to be representative of the position of control valve 77, illustrated in FIG. 1, required to maintain the actual total BTU's provided per hour to the boiler 11 substantially equal to the desired total BTU's per hour represented by the signal 144. This results in the maintenance of a desired steam header pressure. Signal 72 is provided as an output control signal from computer 100 and is utilized as previously described.

Signal 66, which is representative of the actual connection of free oxygen in the stack gases, is provided as the process variable input to the controller 151. The controller 151 is also provided with a set point signal 152 which is representative of the desired concentration of free oxygen in the stack gases. The desired concentration of free oxygen is typically selected so as to substantially maximize the energy efficiency of the combustion process.

In response to signals 152 and 66, the controller 151 provides an output signal 154 which is responsive to the difference between signals 66 and 152. Signal 154 is scaled so as to be representative of the ratio of air to offgas and fuel gas required to maintain the actual concentration of free oxygen in the stack gases substantially equal to the desired concentration represented by signal 152. Signal 154 is provided from the controller 151 as a first input to the multiplying block 156.

Signal 57, which is representative of the actual flow rate of air through conduit 25, is provided as a second input to the multiplying block 156. Signal 154 is multiplied by signal 57 to establish signal 159 which is representative of the total flow rate of offgas and fuel gas required to maintain the actual concentration of free oxygen in the stack gas substantially equal to a desired concentration. Signal 159 is multiplying block 161.

The average BTU block 116 is also provided with signal 124 which has the same magnitude as signal 124 supplied to the multiplying block 123. Thus, the average BTU block 116 is provided with the BTU content of the offgas, the BTU content of the fuel gas and the ratio of offgas to the total of fuel gas and offgas provided to the boiler 11. In response to these inputs, the average BTU content of the total gases provided as fuel to the boiler 11 is calculated. Signal 164, which is representative of such average BTU content, is provided from the average BTU block 116 as a second input to the multiplying block 161.

Signal 159 is multiplied by signal 164 to establish signal 165 which is representative of the number of BTU's per hour which must be provided by the offgas and fuel gas in order to maintain the actual concentration of free oxygen in the stack gases substantially equal to a desired concentration. Signal 165 is provided from the multiplying block 161 as the set point input to the controller block 149.

In response to signals 147 and 165, the controller block 149 provides an output signal 73 which is responsive to the difference between signals 147 and 165. Signal 73 is scaled so as to be representative of the position of control valve 79, illustrated in FIG. 1, required to maintain an air flow rate which will result in the maintenance of a desired concentration of free oxygen in the stack gases. Signal 73 is provided as a control signal from computer 100 and is utilized as previously described.

It is noted that cross limiting control would typically be utilized to prevent the fuel flow rate from changing before the air flow rate changes under certain circumstances and vice-versa under other circumstances. However, since such cross limiting control is conventional and does not play a part in the description of the present invention, such cross limiting control has not been illustrated or described.

As has been previously stated, the control system is highly interactive. The flow of offgas is not controlled so that all offgas is provided to the boiler 11 for combustion. It is necessary to provide sufficient fuel gas to maintain a desired offgas to total gases ratio. However, if the steam header pressure is at a desired value, the control system would not allow more fuel gas to be added if required without the provision of the vent 19. Through the venting of steam, additional fuel gas can be provided so as to maintain a desired offgas to total gases ratio. Thus, all offgas is combusted while still maintaining a desired offgas to total gas ratio and also maintaining a desired steam header pressure and a desired concentration of free oxygen in the stack gases.

The invention has been described in terms of a preferred embodiment as illustrated in FIGS. 1 and 2. Specific components used in the practice of the invention as illustrated in FIG. 1 such as pressure transducers 36 and 61; flow transducers 41, 51 and 52; flow sensors 42, 54 and 55; the control valves 75, 77 and 79 are each well known, commercially available control components such as are described at length in Perry's Chemical Engineers' Handbook, 4th Ed., chapter 22, McGraw-Hill.

For reasons of brevity, conventional auxiliary equipment such as pumps, heat exchangers, additional measurement-control devices, etc., have not been included in the above description as they play no part in the explanation of the invention.

While the invention has been described in terms of the presently preferred embodiment, reasonable variations and modifications are possible by those skilled in the art. Such variations and modifications are within the scope of the described invention as claimed.

Which is claimed is:

1. Apparatus comprising:

a boiler having a burner and a stack associated therewith;

a steam header conduit;

means for providing steam from said boiler to said steam header conduit;

means for venting steam from said steam header conduit;

means for providing a low BTU content offgas to said burner;

means for providing a fuel gas to said burner, wherein the BTU content of said fuel gas is much greater than the BTU content of said offgas;

means for providing air to said burner, wherein the combustion of said offgas and said fuel gas with said air at said burner supplies heat to said boiler;

means for establishing a first signal representative of the actual ratio of the heat supplied by said offgas to said boiler to the total heat supplied by said offgas and said fuel gas to said boiler;

means for establishing a second signal representative of the desired ratio of the heat supplied by said offgas to said boiler to the total heat supplied by said offgas and said fuel gas to said boiler;

means for comparing said first signal and said second signal and for establishing a third signal which is responsive to the difference between said first signal and said second signal, wherein said third signal is scaled so as to be representative of the amount of steam which should be vented from said steam header conduit in order to maintain the actual ratio represented by said first signal substantially equal to the desired ratio represented by said second signal;

Means for controlling the venting of steam from said steam header conduit in response to said third signal;

means for establishing a fourth signal representative of the actual pressure in said steam header conduit;

means for establishing a fifth signal representative of the desired pressure in said steam header conduit;

means for comparing said fourth signal and said fifth signal and for establishing a sixth signal which is responsive to the difference between said fourth signal and said fifth signal, wherein said sixth signal is scaled so as to be representative of the total amount of heat which must be provided to said boiler by said fuel gas and said offgas in order to maintain the actual steam header pressure represented by said fourth signal substantially equal to the desired steam header pressure represented by said fifth signal;

means for establishing a seventh signal representative of the actual total heat being supplied to said boiler by said offgas and said fuel gas;

means for comparing said sixth signal and said seventh signal and for establishing an eighth signal which is responsive to the difference between said sixth signal and said seventh signal, wherein said eighth signal is scaled so as to provide a control signal for manipulating the flow rate of said fuel gas; and means for manipulating the flow rate of said fuel gas in response to said eighth signal.

2. Apparatus in accordance with claim 1 wherein said offgas is provided from the bag filters associated with a carbon black manufacturing process and wherein said means for establishing said first signal comprises:

means for establishing a ninth signal representative of the measured flow rate of said offgas;

means for establishing a tenth signal representative of the actual pressure of said offgas;

means for establishing an eleventh signal representative of the actual flow rate of said offgas in standard cubic feet per hour in response to said ninth and tenth signals;

means for establishing a twelfth signal representative of the number of BTU's contained in each standard cubic foot of said offgas; and means for multiplying said eleventh signal by said twelfth signal to establish said first signal.

3. Apparatus in accordance with claim 1 wherein said means for controlling the venting of steam in response to said third signal and said means for controlling the flow rate of said fuel gas in response to said eighth signal comprises:

a first control valve, operably located so as to control the venting of said steam, wherein said third signal is scaled so as to be representative of the position of said first control valve required to maintain the actual ratio represented by said first signal substantially equal to the desired ratio represented by said second signal;

means for manipulating said first control valve in response to said third signal;

a second valve operably located so as to control the flow of said fuel gas, wherein said eighth signal is scaled so as to be representative of the position of said second control valve required to maintain the actual steam header pressure represented by said fourth signal substantially equal to the desired steam header pressure represented by said fifth signal; and means for manipulating said second control valve in response to said eighth signal.

4. Apparatus in accordance with claim 1 additionally comprising:

means for establishing a ninth signal representative of the heat which must be provided to said boiler by said offgas and said fuel gas in order to maintain the actual concentration of free oxygen in the stack gases flowing through said stack substantially equal to a desired concentration of free oxygen in said stack gases;

means for comparing said ninth signal and said seventh signal and for establishing a tenth signal which is responsive to the difference between said ninth signal and said seventh signal, wherein said tenth signal is scaled so as to provide a control signal for manipulating the flow rate of said air to said burner; and means for manipulating the flow rate of said air in response to said tenth signal.

5. Apparatus in accordance with claim 4 wherein said means for establishing said ninth signal comprises:

means for establishing an eleventh signal representative of the actual concentration of free oxygen in said stack gases;

means for establishing a twelfth signal representative of the desired concentration of free oxygen in said stack gases;

means for comparing said eleventh signal and said twelfth signal and for establishing a thirteenth signal which is response to the difference between said eleventh signal and said twelfth signal, wherein said thirteenth signal is scaled so as to be representative of the ratio of the flow rate of said air to the total flow rate of said offgas and said fuel gas required to maintain the actual concentration of free oxygen in said stack gases substantially equal to the desired concentration represented by said twelfth signal;

means for establishing a fourteenth signal representative of the actual flow rate of said air;

means for multiplying said thirteenth signal and said fourteenth signal to establish a fifteenth signal representative of the total flow rate of said offgas and said fuel gas required to maintain the actual concentration of free oxygen in said stack gases substantially equal to the desired concentration represented by said twelfth signal;

means for establishing a sixteenth signal representative of the average BTU content of a combination of said offgas and said fuel gas actually supplied to said burner; and means for multiplying said fifteenth signal and said sixteenth signal to establish said ninth signal.

6. Apparatus in accordance with claim 4 wherein said means for manipulating the flow rate of air in response to said tenth signal comprises:

a control valve operably located so as to control the flow of said air, wherein said tenth signal is scaled so as to be representative of the position of said control valve required to maintain the actual concentration of free oxygen in said stack gases substantially equal to a desired concentration; and means for manipulating said control valve in response to said tenth signal.

7. A method for controlling a combustion process at a burner associated with a boiler, wherein steam from said boiler is provided to a steam header conduit, wherein a low BTU offgas, a fuel gas and air are provided to said burner, wherein the BTU content of said fuel gas is much greater than the BTU content of said offgas and wherein the combustion of said offgas and said fuel gas with said air at said burner supplies heat to said boiler, said method comprising the steps of;

establishing a first signal representative of the actual ratio of the heat supplied by said offgas to said boiler to the total heat supplied by said offgas and said fuel gas to said boiler;

establishing a second signal representative of the desired ratio of the heat supplied by said offgas to said boiler to the total heat supplied by said offgas and said fuel gas to said boiler;

comparing said first signal and said second signal and establishing a third signal which is responsive to the difference between said first signal and said second signal, wherein said third signal is scaled so as to be representative of the amount of steam which should be vented from said steam header conduit in order to maintain the actual ratio represented by said first signal substantially equal to the desired ratio represented by said second signal;

controlling the venting of steam from said steam header conduit in response to said third signal;

establishing a fourth signal representative of the actual pressure in said steam header conduit;

establishing a fifth signal representative of the desired pressure in said steam header conduit;

comparing said fourth signal and said fifth signal and establishing a sixth signal which is responsive to the difference between said fourth signal and said fifth signal, wherein said sixth signal is scaled so as to be representative of the total amount of heat which must be provided to said boiler by said fuel gas and said offgas in order to maintain the actual steam header pressure represented by said fourth signal substantially equal to the desired steam header pressure represented by said fifth signal;

establishing a seventh signal representative of the actual total heat being supplied to said boiler by said offgas and said fuel gas;

comparing said sixth signal and said seventh signal and establishing an eighth signal which is responsive to the difference between said sixth signal and said seventh signal, wherein said eighth signal is scaled so as to provide a control signal for manipulating the flow rate of said fuel gas; and manipulating the flow rate of said fuel gas in response to said eighth signal.

8. A method in accordance with claim 7 wherein said offgas is provided from the bag filters associated with a carbon black manufacturing process and wherein said step of establishing said first signal comprises:

establishing a ninth signal representative of the measured flow rate of said offgas;

establishing a tenth signal representative of the actual pressure of said offgas;

establishing an eleventh signal representative of the actual flow rate of said offgas in standard cubic feet per hour in response to said ninth and tenth signals;

establishing a twelfth signal representative of the number of BTU's contained in each standard cubic foot of said offgas; and multiplying said eleventh signal by said twelfth signal to establish said first signal.

9. A method in accordance with claim 7 wherein said step of controlling the venting of steam in response to said third signal and said step of controlling the flow rate of said fuel gas in response to said eighth signal comprises:

scaling said third signal so as to be representative of the position of a first control valve, operably located so as to control the venting of said steam, required to maintain the actual ratio represented by said first signal substantially equal to the desired ratio represented by said second signal;

manipulating said first control valve in response to said third signal;

scaling said eighth signal as to be representative of the position of a second control valve, operably located so as to control the flow of said fuel gas, required to maintain the actual steam header pressure represented by said fourth signal substantially equal to the desired steam header pressure represented by said fifth signal; and manipulating said second control valve in response to said eighth signal.

10. A method in accordance with claim 7 additionally comprising the steps of:

establishing a ninth signal representative of the heat which must be provided to said boiler by said offgas and said fuel gas in order to maintain the actual concentration of free oxygen in the stack gases flowing through the stack associated with said said boiler substantially equal to a desired concentration of free oxygen in said stack gases;

comparing said ninth signal and said seventh signal and establishing a tenth signal which is responsive to the difference between said ninth signal and said seventh signal, wherein said tenth signal is scaled so as to provide a control signal for manipulating the flow rate of said air to said burner; and manipulating the flow rate of said air in response to said tenth signal.

11. A method in accordance with claim 10 wherein said step of establishing said ninth signal comprises:

establishing an eleventh signal representative of the actual concentration of free oxygen in said stack gases;

establishing a twelfth signal representative of the desired concentration of free oxygen in said stack gases;

comparing said eleventh signal and said twelfth signal and establishing a thirteenth signal which is response to the difference between said eleventh signal and said twelfth signal, wherein said thirteenth signal is scaled so as to be representative of the ratio of the flow rate of said air to the total flow rate of said offgas and said fuel gas required to maintain the actual concentration of free oxygen in said stack gases substantially equal to the desired concentration represented by said twelfth signal;

establishing a fourteenth signal representative of the actual flow rate of said air;

multiplying said thirteenth signal and said fourteenth signal to establish a fifteenth signal representative of the total flow rate of said offgas and said fuel gas required to maintain the actual concentration of free oxygen in said stack gases substantially equal to the desired concentration represented by said twelfth signal;

establishing a sixteeth signal representative of the average BTU content of a combination of said offgas and said fuel gas actually supplied to said burner; and multiplying said fifteenth signal and said sixteenth signal to establish said ninth signal.

12. A method in accordance with claim 10 wherein said step of manipulating the flow rate of air in response to said tenth signal comprises:

scaling said tenth signal so as to be representative of the position of a control valve, operably located so as to control the flow of said air, required to maintain the actual concentration of free oxygen in said stack gases substantially equal to a desired concentration; and manipulating said control valve in response to said tenth signal.

* * * * *